US005493848A

United States Patent [19]

McKibben et al.

[11] Patent Number: 5,493,848

[45] Date of Patent: Feb. 27, 1996

[54] CLAMSHELL PACKAGE CLOSING MACHINE AND PROCESS

[75] Inventors: Jeffrey D. McKibben; Horace E. McKibben, both of Grand Junction, Mich.

[73] Assignee: McKibben Manufacturing, Inc., Grand Junction, Mich.

[21] Appl. No.: 345,140

[22] Filed: Nov. 28, 1994

[51] Int. Cl.[6] ..... B65B 7/16

[52] U.S. Cl. ..... 53/484; 53/467; 53/437; 53/525

[58] Field of Search ..... 53/467, 437, 484, 53/525, 284.5, 376.3, 377.6, 378.3, 491, 377.2; 493/177, 441

[56] References Cited

U.S. PATENT DOCUMENTS

| | | | |
|---|---|---|---|
| 1,418,451 | 6/1922 | Ney | 53/376.3 |
| 2,224,716 | 12/1940 | Anderson | 93/6 |
| 2,242,304 | 5/1941 | Johnson | 93/3 |
| 2,927,411 | 3/1960 | Kerr | 53/376 |
| 2,971,443 | 2/1961 | Striplin | 93/36 |
| 3,015,198 | 2/1962 | Becker | 53/387 |
| 3,253,389 | 5/1966 | Miller et al. | 53/377.2 |
| 3,267,637 | 8/1966 | Baker | 53/38 |
| 3,307,329 | 3/1967 | Lefief | 53/378.3 |
| 3,443,353 | 5/1969 | Vecchio | 53/38 |
| 3,722,176 | 3/1973 | Hordijk | 53/376 |
| 3,726,061 | 4/1973 | Pagdin et al. | 53/377.2 |
| 3,818,675 | 6/1974 | Griner | 53/233 |
| 4,590,745 | 5/1986 | Randles | 53/541 |
| 4,672,792 | 6/1989 | Wallin | 53/374 |
| 4,987,727 | 1/1991 | McClusky et al. | 53/525 |
| 5,092,108 | 3/1992 | Gottfreid | 53/526 |
| 5,249,406 | 10/1993 | Kalmanides | 53/377.5 |

*Primary Examiner*—John Sipos
*Assistant Examiner*—Gene Kim
*Attorney, Agent, or Firm*—Joseph K. Andonian

[57] ABSTRACT

A machine and process for more efficient closing of a filled clamshell package at a faster rate than previous machines or processes intended for the same purpose. The machine is most useful for packaging agricultural products such as berries.

11 Claims, 3 Drawing Sheets

CLAMSHELL PACKAGE CLOSING MACHINE AND PROCESS

FIELD OF INVENTION

This invention relates to a clamshell package closing machine and process for closing the top over the bottom of a clamshell package in a more efficient and economical manner than previous machines utilized for the same purpose. The invention is especially useful for packaging agricultural products such as berries.

BACKGROUND OF INVENTION

Clamshell packages consist of a bottom portion (cup) capable of holding material to be enclosed in the package and a top portion (lid) hinged to one side of the bottom portion. The top portion folds over the bottom portion and the two portions are locked or press fitted to each other at their outer edges generally by pressure applied to the top portion. The name of the package is derived from its similarity to a clamshell. Since the package is simple in construction it provides a very economical and convenient means for enclosing, stacking, storing, shipping and dispensing many materials such as food products. Blueberries, strawberries and cherries are typical examples of foods that are commonly packaged in clamshell containers. If the package is made out of a transparent material such as a thin flexible plastic such as polyethylene tetrafluoride, the contents can also be attractively displayed. The package is designed to be readily opened and reclosed manually so the contents can be removed in whole or in part and the package can be reused if desired. The packages are available in various sizes with various closing mechanisms, the only limitation on the latter feature for purposes of the present invention is the ability of the top portion or lid to snap or press shut snugly over the bottom portion or cup by applying pressure on the top surface of the lid.

The prior art contains several examples of processes and machines for closing clamshell packages. It also contains several examples of processes and machines for closing cartons, boxes and other packages utilizing mechanisms similar to some of the mechanisms of the present invention. However, none disclose an automated process or machine that is designed to orient a package so that the hinge of the part being closed is on the trailing edge of the package with respect to the direction the package is traveling on a conveyer belt during the process of closing. The hinge orientation of the present invention closes the package with the hinge instead of against it. Other features of the present invention not shown in the prior art include the turning mechanism employed, the slightly faster speed of the top belt as it applies pressure to the clamshell container lid as the container moves along a conveyer and the ability of the lid to fit snugly over the bottom portion of the container by the simple application of pressure. These and other novel features in combination unexpectedly lead to almost 100% closure of the package at a faster speed than previous machines employed for the same purpose.

U.S. Pat. Nos. 2,224,716 2,927,411 3,267,637 3,443,353 4,590,745 and 4,672,792 are examples of patents that disclose box or carton closing machines having some mechanisms similar to that of the present invention. They differ in providing closing mechanisms that close cartons with hinged tops with at least three flaps that are attached to the carton body with adhesives or locking tabs. U.S. Pat. No. 2,971,443 is very similar except that hinged top to be closed has only a front flap attached with adhesive to the body of the carton. U.S. Pat. Nos. 2,242,304 4,722,176 and 5,249,406 are examples of patents that disclose clamshell closing machines but do not disclose closing mechanisms similar to that of the present invention. U.S. Pat. No. 5,092,108 discloses a mechanism for closing a two piece carton, i.e., a carton whose top is not hinged to the body of the carton. U.S. Pat. No. 3,015,198 discloses a mechanism for closing a conventional carton, i.e., one whose top and bottom has four hinged flaps with opposed pairs of transverse inner flaps and longitudinal outer flaps. None of these patents alone or in combination disclose mechanisms adapted to close the package with the hinged portion of the package trailing the package as it moves through the closing mechanism of the machine. None of these patents disclose a top belt that effects more efficient closure by moving at a slightly faster speed than the conveyer employed to move the package under the top belt. None of these patents disclose mechanisms that close packages or containers where the top is adapted to fit snugly over the bottom by the simple application of pressure on the top. Most include mechanisms that apply adhesives, lock hooks, interlock tabs or press buttons into wells to effect closure.

OBJECTS AND ADVANTAGES

The principal object of this invention is to provide a economical machine for closing clamshell packages automatically with nearly 100% efficiency at a faster rate than previously possible.

Another object is to provide a machine and process to accomplish closure of clamshell packages by the simple application of pressure to the top surface of the lid as the package moves along a conveyer with the hinged side trailing the package using a top belt moving at a slightly faster speed than the conveyer.

Other objects will be apparent from the description which follows.

SUMMARY OF INVENTION

The essential features of the present invention in its broadest aspects consist essentially of a closing mechanism adapted to close a clamshell package having a lid hinged to a filled cup moving on a conveyer with the hinged side of the package on the trailing edge of the package. The closing mechanism employs belt means located over the top of the package wherein the belt means (a) is moving slightly faster than the conveyer moving the package and (b) is preferably initially positioned to allow the lid to open slightly on its own and thence engage the top surface of the lid more tightly. This action creates very quick traction on the lid and forces it down to a more firmly locked position over the cup of the package. This method of closing a substantially rectangular package is more efficient and faster than previous package closing methods. The inventors have achieved over 98% closure at a faster rate packaging agricultural products such as blueberries compared to previous machines using other means to apply pressure to close the lid over the cup of the container.

List of Reference Numerals

Figure 1:
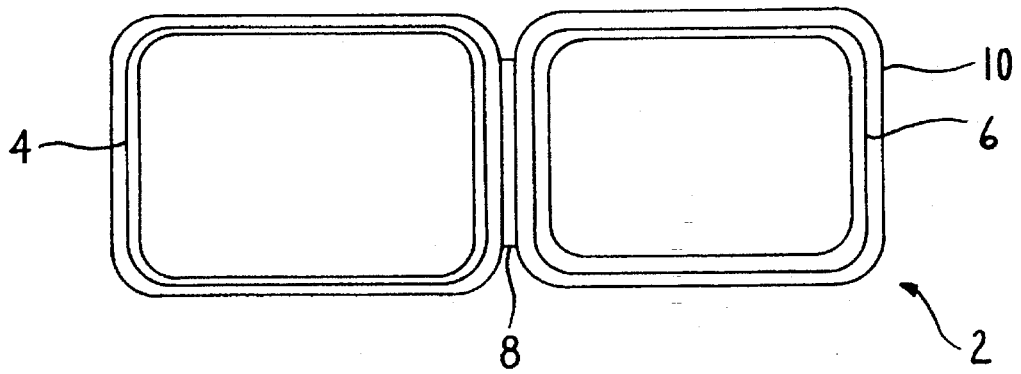
FIGS. 1 and 2 depict top and side views of an open clamshell package suitable for the present invention.

2 Clamshell package
4 Lid or cover
6 Cup or body
8 Hinge
10 Flange
11 First conveyer channel
12 Transporting conveyer
13 Second conveyer channel
14 Guide rail for closing cover
16, 18, 20 and 22 Guide rails for sides
24 Powered circular brush or wheel no. 1
25 Powered circular brush or wheel no. 2
26 Finger of brush
27 Belt connecting brush no. 1 to brush no. 2
28 V-belts
30, 32 and 34 Pulleys
36 Stop
38 Supporting plates for V-belts
40 Suction cup
42A Conveyer belt
42B Conveyer belt
44A Conveyer belt
44B Conveyer belt
46A Conveyer belt
46B Conveyer belt
46C Conveyer belt

DETAILED DESCRIPTION OF A PREFERRED EMBODIMENT OF THE INVENTION

Figure 2:
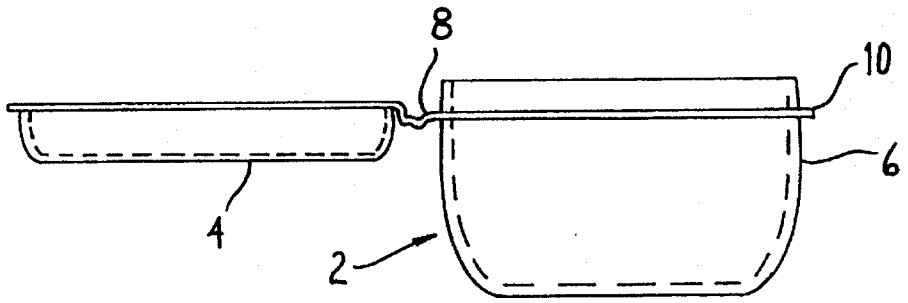
Figure 3:
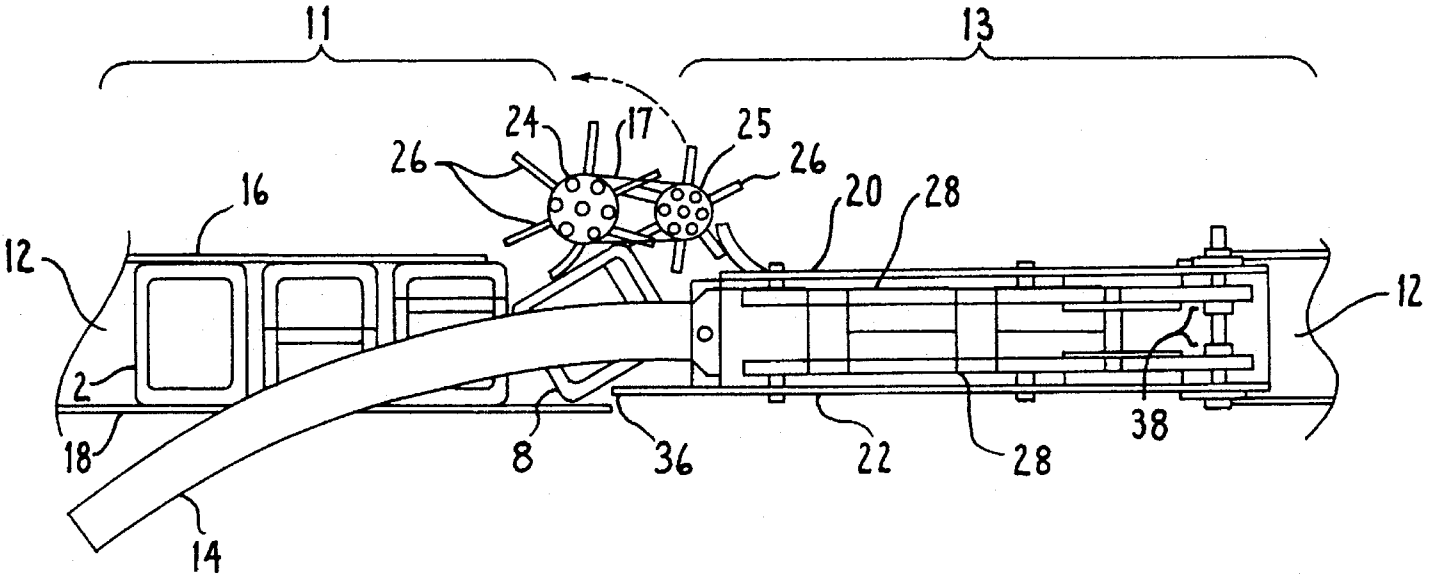
FIG. 3 depicts a top plan view of the clamshell closing machine.

The mechanism depicted in FIGS. 2 and 3 is attached to a stationary table top which is not shown in the drawings. Also not shown in the drawings are the parts of a complete machine that would include (1) the motors for driving the conveyer 12, the V-belts 28, a vibrator (also not shown) and a pair of connected powered brushes 24 and 25, (2) the mechanism (including suction cup 40) that picks a clamshell package 2 from the bottom of a stack of empty packages and starts it down the conveyer 12 in an open condition with the lid 4 and the hinge 8 positioned parallel to the direction the conveyer belt 12 is moving on the same side of the conveyer as the pivot point, namely stop 36, (3) the mechanism for filling the cup 6 of the package 12 with the product to be packaged such as blueberries which, for example, can be funneled into the cup by the force of gravity, (4) the vibrator designed to shake out excess product from the cup after filling and (4) the structure, such as a table, for holding the filled and closed package 2 at the end of the conveyer 12 prior to placement into larger cartons for storage or shipping. None of these mechanisms are critical to the broad concept of the present invention and can readily be provided in numerous specific embodiments by those skilled in the machinery arts. The only limitation on the mechanisms utilized prior to the closing operation is that they present the package to the closing mechanism with the hinged side trailing the package.

Typical of the type of clamshell package suitable for the present invention is the one pint transparent plastic package available from Ultra Pac, Inc., of Rogers, Minn., and identified by the supplier's number 5040-276. This substantially rectangular package with slightly rounded corners is fully depicted in U.S. Pat. No. Des. 343,576. The package utilizes a tongue and groove connector on all four corners to facilitate the closing action of the package. Packaging Corporation of America of Evanston, Ill., and Monte Packaging Company, Inc., of Riverside, Mich., also supply packages that are suitable for the present invention, albeit they employ somewhat different means for closing the package snugly. A pressure fit of the lid to the cup sufficient to avoid spillage under normal shipping and handling conditions is all that is required for purposes of the present invention.

The preferred package filling operation requires that the package 2 be oriented with the lid 4 open and positioned away from the space over the conveyer 12 so the cup 6 can be gravity filled without interference from the lid 4. This orientation of the cup 6 is initially accomplished by the mechanism that pulls each wide open, empty package 2 from the bottom of a stack positioned over first part of conveyer 12 preferably by creating a vacuum inside a suction cup 40 and releasing the package 2 by eliminating the vacuum as soon as the package 2 contacts conveyer belts 42A and 42B. These narrow belts 42A and 42B are positioned to contact the outer edges of the bottom of cup 6 primarily to permit the suction cup 40 to be positioned between the belts. At this point the hinge of the package 2 must be parallel to the movement of the conveyer on the same side of conveyer 12 as stop 36. Conveyer belts 42A and 42B preferably move approximately twice as fast as conveyer belts 44A and 44B to eliminate empty spaces between the packages during the gravity filling operation.

The filling mechanism would advantageously consist of a funnel-shaped hopper open at the bottom and filled for example with blueberries so that the open package 2 will be filled as the package passes directly under the hopper on the conveyer 12. The dimensions of the open bottom end of the hopper would preferably match the dimensions of and be positioned directly over the top edge of the cup 6.

The third section of conveyer 12 beyond the package filling mechanism preferably has a configuration consisting of three narrow belts, 46A positioned to contact the bottom edge of one side of cup 6, 46C positioned to contact the bottom edge of the other side of cup 6, and 46B positioned to contact the center of the bottom surface of cup 6. The space between the three belts 46A 46B 46C should be sufficient so that a vibrator under the conveyer 12 can vibrate the package sufficiently to shake any overfilled berries over the top edges of cup 6 and drop them through the spaces between the belts. The vibrator preferably consists of a roller positioned directly under conveyer 12 in contact with belts 46A, 46B and 46C. The vibration is imparted to the roller by an off-centered cam wheel. The properly filled package is then ready for the lid 4 to be closed loosely over the cup 6 by the guide rail 14. Three belts are desirable at this part of conveyer 12 to create sufficient traction to move the heavier filled package. This section of conveyer 12 should also move faster than the second section to create more pressure to overcome the friction and prevent jamming of the turning mechanism.

Figure 4:
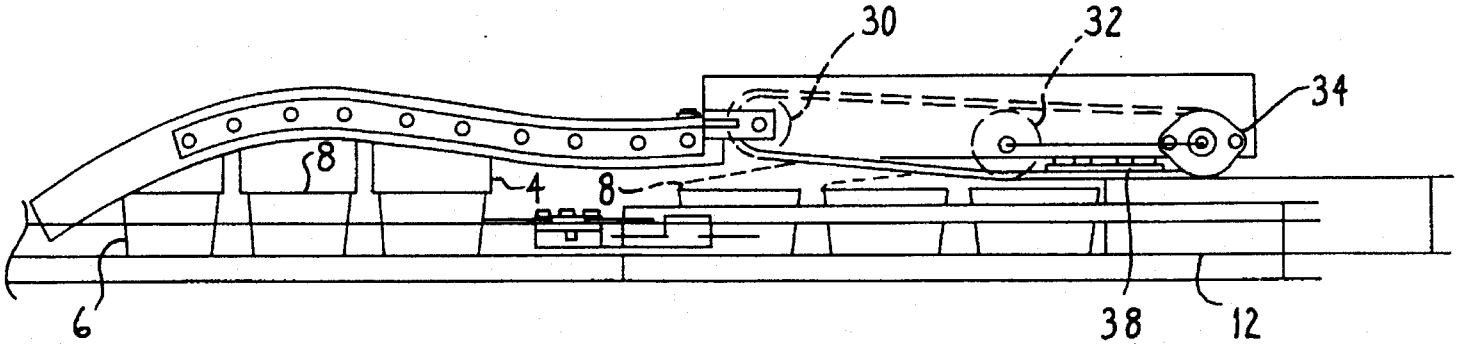
FIG. 4 depicts a side view of the clamshell closing machine.
Figure 5:
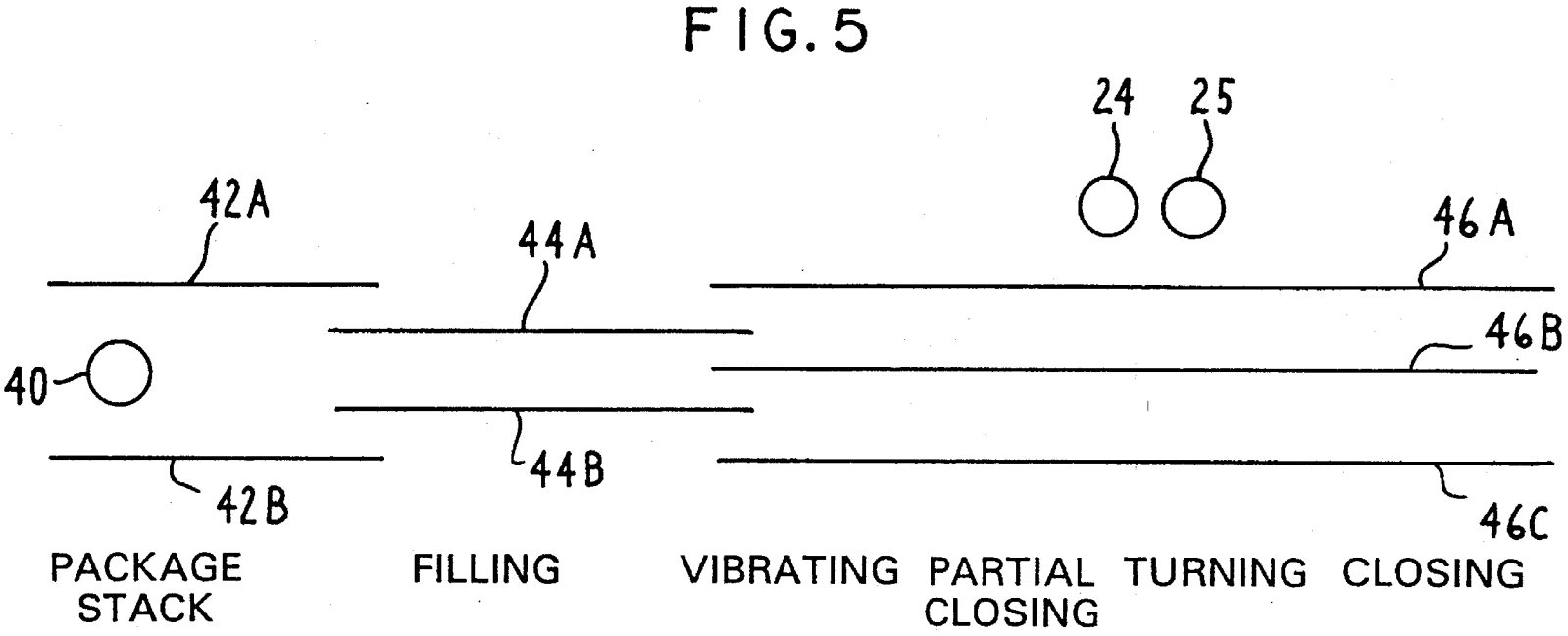
FIG. 5 is a schematic overhead view of the three parts of the conveyer and illustrates the relative positions of the major mechanisms that make up the machine.

In the preferred embodiment of the invention depicted in FIGS. 3 and 4 the transporting conveyer 12 transports the open clamshell package 2 whose cup 6 is already filled with the product to be packaged, such as blueberries, along conveyer channel 11 to the turning area of the machine. At this point the package 2 is still oriented with the hinged side 8 parallel to the movement of the conveyer 12 in conveyer channel 11. The guide rail 14 engages the lid 4 and lifts it loosely over to the cup 6 to prevent the contents from falling out as the package approaches the turning area of the machine where it makes the 90% turn required prior to the closing operation. The turn begins when the bottom of the package 2 on the hinged 8 side engages the stop 36 which acts as a pivot point at the beginning of second conveyer channel 13 and is simultaneously contacted on the other side of the channel 13 preferably by the six finger 26 pair of powered connected brushes 24 and 25 turning in the same direction as the package 2 is moving down the conveyer 12. The brushes 24 and 25 are connected to each other by a belt 27 driven by a single motor and are paired for more effective turning. The conveyer 12 is preferably supported by a fixed plate, not shown in the drawings, positioned directly under the conveyer 12 adjacent to the turning wheels 24 and 25. When the turn is complete the package 2 continues along the conveyer 12 into offset conveyer channel 13. The package 2 is now in the desired orientation with the hinged side 8 on the trailing edge of the package 2. The lid 4 is snapped over the cup 6 using two powered V-belts 28 mounted directly over the sides of lid 4. The first 9 inches of the V-belts are preferably inclined upwards approximately one inch initially to allow lid 4 to open slightly on its own and tapers down to create very quick traction on the top of the lid 4 as the package 2 continues to move along the conveyer 12. The powered V-belts 28 are moving in the same direction but at a slightly faster speed than the conveyer 12 as they contact the top of the lid 4. The powered taper then simply pulls and snaps the lid 3 down to the flange 10 of the cup 6. The supporting plates 38 for the V-belts 28 assure that the belts do not bend up and thus maintain constant pressure on the top of the lid 4.

Scope of Invention

It is to be understood that the above-described embodiments are simply illustrative of the principles of the present invention and are not intended to be limiting. Many modifications and changes can be made by those skilled in the art without departing from the spirit and scope of the present invention which can only be measured by the legal scope of the appended claims.

What is claimed is:

1. A machine for closing a clamshell container having a hinged cover portion connected to said container by a hinged edge adapted to fit snugly over a filled bottom portion which comprises conveyer means capable of moving said container by frictionally engaging the bottom surface of said container, filling means positioned over said conveyer for filling said container with its hinged edge parallel with the movement said conveyer, curved guide rail means following said filling means along said conveyer for partially but not tightly closing said cover, turning means following said guide rail means oriented to turn said container as it approaches said turning means on said conveyer so that the said hinged edge becomes the trailing edge after said container passes said turning means, top belt means positioned over said conveyer and capable of frictionally engaging the top surface of said cover as said container passes under said top belt means wherein the initial portion of said top belt means is inclined upwards toward said container as said container approaches, said top belt means when contacting the top surface of the said cover moves in the same direction as the conveyer belt at a slightly faster speed and said top belt means is capable of gradually forcing said cover to close snugly over said bottom portion of said container to complete the closing operation, and side rail means for preventing said container from turning as it passes under said top belt means.

2. The machine of claim 1 wherein the said filling means is oriented to fill said container with its cover extended in a fully open position and its hinged edge parallel to the movement of said conveyer until said container reaches said turning means.

3. The machine of claim 2 wherein said turning means has stop means positioned to contact the leading end of the hinged edge of said container and wheel means with flexible fingers capable of rotating in the same direction as said conveyer and wherein said stop means and said wheel means are located on opposite sides of said conveyer to turn said container a full ninety degrees before passing under said top belt.

4. The machine of claim 3 wherein said machine has solid stationary support means positioned closely over the portion of said top belt means that would engage the top surface of said cover as said container passes under said top belt means to prevent said top belt from bending upwards.

5. The machine of claim 4 wherein the said top belt means comprises two V-belts positioned to engage the outside edges of said cover as said container passes under said top belt means.

6. A process for closing a clamshell container having a hinged cover portion connected to said container by a hinged edge and adapted to close over a filled bottom portion consisting essentially of moving said container on a conveyer with said cover bent loosely over said bottom portion by frictionally engaging the bottom surface of said container with the hinged edge of said container trailing said container as it moves along the conveyer, frictionally engaging the top surface of said cover with top belt means positioned over said conveyer wherein the initial portion of said top belt means is inclined upwards toward said container as said container approaches, said top belt means is moving in the same direction as the conveyer at a slightly faster speed when contacting the top surface of said cover, said top belt means forces said cover to close snugly over said bottom portion of said container to complete the closing operation so that the said container is fully covered, and side rail means are positioned along said conveyer as said container passes under said top belt means to prevent said package from turning.

7. A process for closing a clamshell container having a hinged cover portion connected to said container by a hinged edge adapted to close over a filled bottom portion which comprises the following steps filling said container with its hinged edge parallel to the direction said container is conveyed on a conveyer by frictionally engaging the bottom surface of said container, folding said cover loosely over the bottom portion of said container by a curved guide rail, turning said container a full ninety degrees to place its hinged edge at the trailing edge of said container, frictionally engaging the top surface of said cover with top belt means positioned over said conveyer wherein the initial portion of said top belt means is inclined upwards toward said container as said container approaches, said top belt means is moving in the same direction as the conveyer at a slightly faster speed when contacting the top surface of said cover, said top belt means forces said cover to close snugly over said bottom portion of said container to complete the closing operation, and side rail means are positioned along said conveyer as said container passes under said top belt means to prevent said package from turning.

8. The process of claim 7 wherein said container is turned by engaging a stop positioned along said conveyer to contact the leading end of the hinged edge of said container and at the same time engage the flexible fingers of a wheeled mechanism rotating in the same direction as said conveyer on the opposite side of said conveyer.

9. The process of claim 8 wherein closure is accomplished by a top belt consisting of two V-belts positioned over the outside edges of said cover.

10. A machine for filling and closing a clamshell container having a hinged cover portion connected to said container by a hinged edge and adapted to fit snugly over the bottom portion which machine comprises conveyer means capable of transporting said container throughout the following operations in sequence, positioning means for placing the bottom portion of said container on said conveyer with the lid fully extended away from the conveyer and the hinged edge of said container parallel with the movement of said conveyer, filling means for filling the bottom portion of said container, guide rail means for lifting the cover portion loosely but not tightly over the bottom portion of said container, turning means including a pivot point on the same side of said conveyer as said positioning means places the hinged edge of said container on said conveyer and wheel means on the opposite side of said conveyer capable of turning said container ninety degrees around said pivot point so that the hinged edge of said container becomes the trailing edge of said container, top belt means positioned over said conveyer and capable of frictionally engaging the top surface of said cover in the same direction and at a slightly faster speed than the speed with which said container moves on said conveyer forcing said cover to close snugly over said bottom portion of said container, and side rail means positioned along said conveyer to prevent said container from turning during the process of filling and closing said container.

11. The machine of claim 10 wherein the said conveyer comprises three parts, the first part preceding the filling mechanism and the third part following the filling mechanism moving at a substantially faster speed than the second part underlying the filling mechanism.

* * * * *